US010741351B1

(12) United States Patent
Ebersohn et al.

(10) Patent No.: US 10,741,351 B1
(45) Date of Patent: Aug. 11, 2020

(54) MULTI-APERTURED CONDUCTION HEATER

(71) Applicant: Lockheed Martin Corporation, Bethesda, MD (US)

(72) Inventors: Frans Hendrik Ebersohn, Palmdale, CA (US); Randall James Sovereign, Palmdale, CA (US); Regina Mariko Sullivan, Palmdale, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 16/529,454

(22) Filed: Aug. 1, 2019

(51) Int. Cl.
*H01J 1/22* (2006.01)
*H01J 1/24* (2006.01)
*H05B 3/14* (2006.01)

(52) U.S. Cl.
CPC ..... *H01J 1/22* (2013.01); *H01J 1/24* (2013.01); *H05B 3/145* (2013.01)

(58) Field of Classification Search
CPC ..... H01J 1/22; H01J 1/24; H01J 9/04; H05B 3/145
See application file for complete search history.

(56) References Cited

U.S. PATENT DOCUMENTS

| | | | | |
|---|---|---|---|---|
| 1,852,023 A | | 4/1932 | Parker | |
| 2,180,714 A | | 11/1939 | McQuade | |
| 2,936,385 A | | 5/1960 | Kaufman | |
| 3,195,004 A | * | 7/1965 | Hassett | H01J 1/22 313/340 |
| 3,265,910 A | | 8/1966 | Thomas | |
| 3,328,201 A | | 6/1967 | Scheible | |
| 4,176,293 A | * | 11/1979 | Giebeler | H01J 1/20 313/337 |
| 4,634,921 A | | 1/1987 | Williams | |
| 5,015,908 A | * | 5/1991 | Miram | H01J 1/15 313/270 |
| 6,897,605 B2 | * | 5/2005 | Roh | H01J 29/02 313/270 |

* cited by examiner

*Primary Examiner* — Donald L Raleigh
(74) *Attorney, Agent, or Firm* — Baker Botts L.L.P.

(57) ABSTRACT

In one embodiment, a system includes a thermionic emitter and a heater at least partially surrounding the thermionic emitter. The heater is configured to heat the thermionic emitter. The heater includes a first end, a second end opposite the first end, and a plurality of hollow insulating tubes that each run from the first end to the second end. The heater also includes a heater wire that runs through each of the hollow insulating tubes. The heater wire is configured to be resistively heated by an electrical current passed through the heater wire.

20 Claims, 5 Drawing Sheets

MULTI-APERTURED CONDUCTION HEATER

TECHNICAL FIELD

This disclosure generally relates to heaters and more specifically to a multi-apertured conduction heater.

BACKGROUND

Certain devices must be heated to very high temperatures for proper operation. For example, thermionic emitters must be heated to over 1600 degrees Celsius in order to emit sufficient electron currents for plasma devices. Present heaters for such devices, however, are prone to failure, are limited in their heating ability, and are difficult or impossible to repair.

SUMMARY OF PARTICULAR EMBODIMENTS

In one embodiment, a system includes a cathode that includes a cathode tube, a thermionic emitter installed at least partially within the cathode tube, and a graphite heater surrounding the cathode tube and configured to heat the thermionic emitter. The graphite heater is in a shape of a hollow circular cylinder. The graphite heater includes a first end, a second end opposite the first end, a plurality of hollow ceramic insulating tubes that each run from the first end to the second end, and a heater wire that runs through each of the hollow ceramic insulating tubes. The heater wire is configured to be resistively heated by an electrical current passed through the heater wire.

In another embodiment, a system includes a cathode that includes a cathode tube, a thermionic emitter installed at least partially within the cathode tube, and a heater surrounding the cathode tube and configured to heat the thermionic emitter. The heater includes a first end, a second end opposite the first end, a plurality of hollow insulating tubes that each run from the first end to the second end, and a heater wire that runs through each of the hollow insulating tubes. The heater wire is configured to be resistively heated by an electrical current passed through the heater wire.

In another embodiment, a system includes a thermionic emitter and a heater at least partially surrounding the thermionic emitter. The heater is configured to heat the thermionic emitter. The heater includes a first end, a second end opposite the first end, and a plurality of hollow insulating tubes that each run from the first end to the second end. The heater also includes a heater wire that runs through each of the hollow insulating tubes. The heater wire is configured to be resistively heated by an electrical current passed through the heater wire.

The present disclosure provides numerous technical advantages over typical systems. As one example, the disclosed heaters are both versatile and easy to repair. As another example, the disclosed heaters may be able to provide increased heating to thermionic emitters, which may improve performance capabilities. Furthermore, the ability to repair the disclosed heaters reduces costs and downtime. In some embodiments, the heaters may be directly integrated into a cathode tube, which provides improved performance, lowers component count, and reduces cost.

Other technical advantages will be readily apparent to one skilled in the art from the following figures, descriptions, and claims. Moreover, while specific advantages have been enumerated herein, various embodiments may include all, some, or none of the enumerated advantages.

DESCRIPTION OF EXAMPLE EMBODIMENTS

Thermionic emitters are used to emit electron currents critical for many different plasma devices. For example, thermionic emitters are critical components of cathodes that are used in electron sources, plasma sources, and electric propulsion devices for spacecraft (e.g., ion thrusters). Thermionic emitters must be heated to extremely high temperatures (e.g., ~1600 degrees Celsius) in order to emit sufficient electron currents. Higher temperatures lead to more electron emission, higher achievable currents, and better plasma device performance. High emission currents lower the required break-down voltages and are also important for fast plasma turn on.

Devices that utilize a thermionic emitter typically include a heater that heats the thermionic emitter to emission temperatures. However, typical heaters (e.g., coil heaters) are prone to failure and are typically limited in their temperature heating capability (e.g., typically limited to around 1700 degrees Celsius). Furthermore, most heater designs are very difficult to repair or are irreparable altogether.

To address these and other challenges with typical heaters for thermionic emitters, the disclosed embodiments provide a heater that is capable of operating at higher temperatures while also being easy to repair through a simple design and appropriate selection of materials. In some embodiments, a heater for a thermionic emitter is a multi-apertured graphite hollow tube which is used to hold high-temperature ceramic insulators. In some embodiments, multiple holes/apertures are drilled into the graphite tube to serve as the holders for the ceramic insulator tubes. In some embodiments, these ceramic insulators house a refractory metal heater wire. The heater wire may be resistively heated by a current running through the heater wire, which in turn heats the electrical insulators, the graphite tube, and ultimately the thermionic emitter. The heater wire, in some case, snakes in-and-out through of each of the ceramic tubes to achieve the desired resistance for the heater wire. In some embodiments, the heater is surrounded by a reflective foil to improve the efficiency of the heater.

To facilitate a better understanding of the present disclosure, the following examples of certain embodiments are given. In no way should the following examples be read to limit, or define, the scope of the disclosure. Embodiments of the present disclosure and its advantages may be best understood by referring to the include FIGURES, where like numbers are used to indicate like and corresponding parts.

Figure 1:
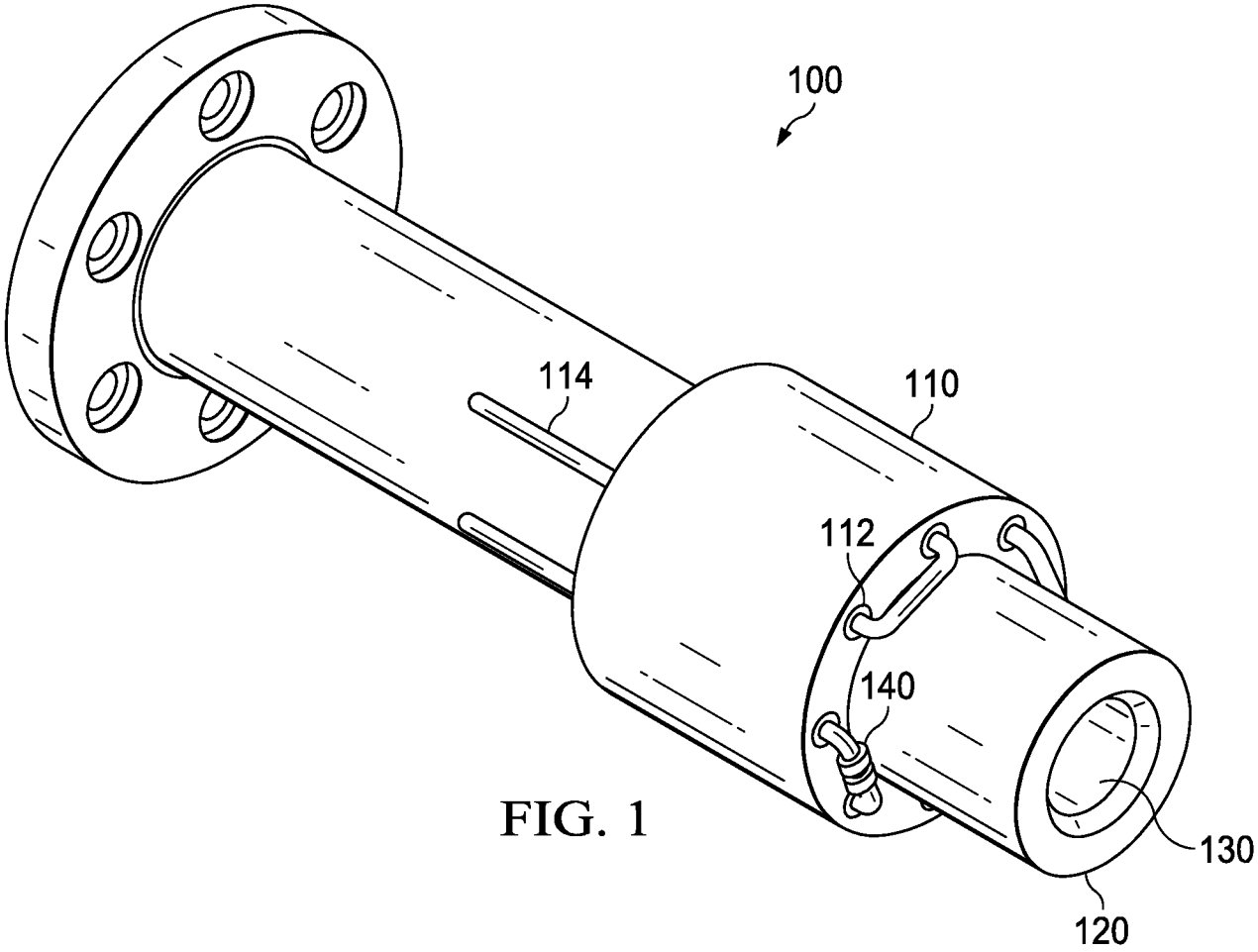
FIG. 1 illustrates an example cathode, according to certain embodiments.

FIG. 1 illustrates an example cathode 100, in accordance with embodiments of the present disclosure. In some embodiments, cathode 100 includes a heater 110, a cathode tube 120, and a thermionic emitter 130 that is installed either partially or fully within cathode tube 120. In some embodiments, heater 110 partially or fully surrounds cathode tube 120. In other embodiments, heater 110 is integrated within cathode tube 120.

In general, cathode 100 may be used in a device such as an electron source, plasma source, or electric propulsion device for a spacecraft (e.g., an ion thruster). Heater 110 heats thermionic emitter 130 in order to create electron currents from thermionic emitter 130 to be used in a plasma device such as an ion thruster. As described in more detail below, a heater wire 114 runs through insulating tubes 112 of heater 110 in order to heat thermionic emitter 130 and create the desired electron currents from thermionic emitter 130. Unlike other typical heaters, however, heater 110 provides a configuration that is capable of greater heating capacity and is much easier to repair through a simple design and appropriate material selections. As a result, heater 110 provides increase performance for devices such as cathode 100 and helps to reduce costs and operational downtime.

Figure 2:
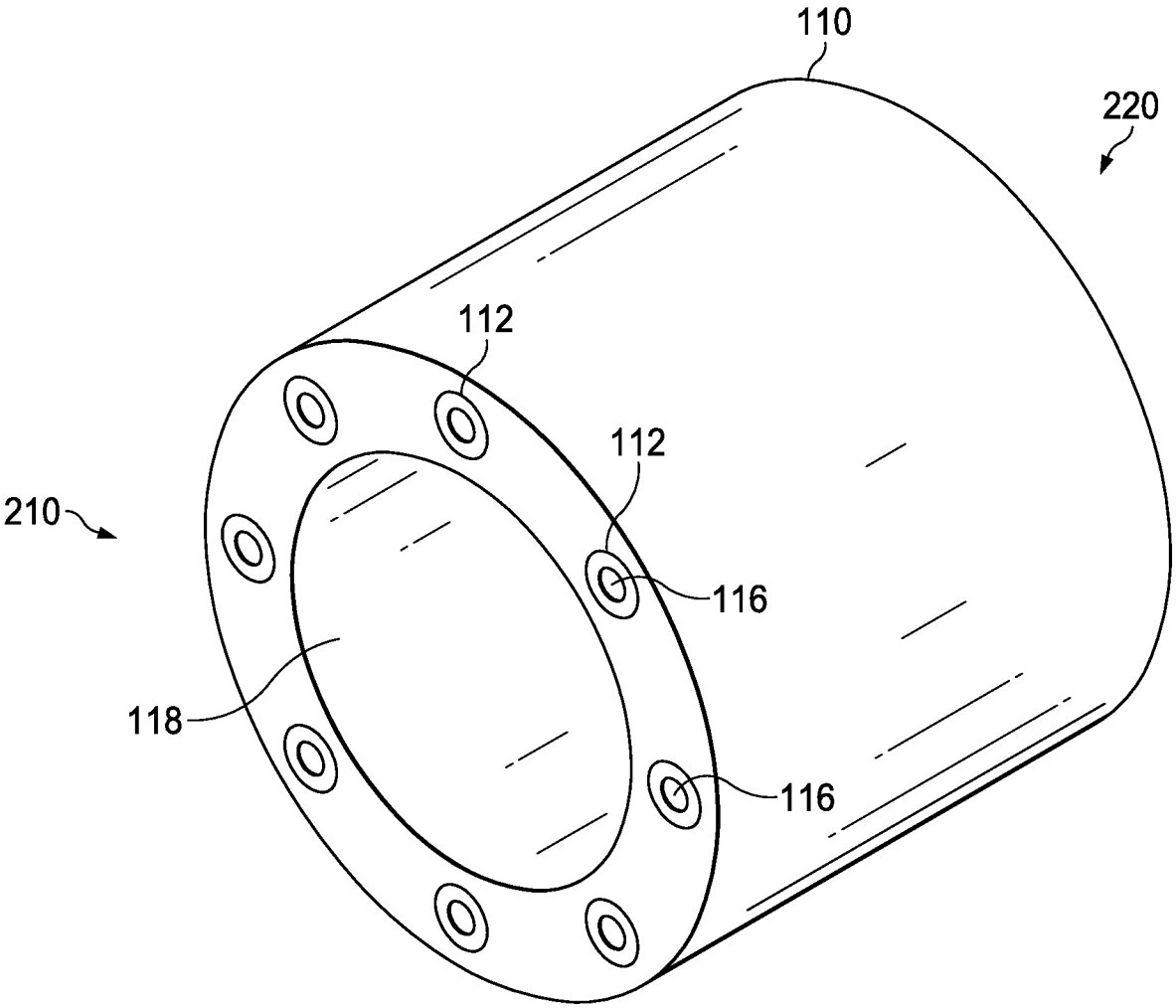
FIG. 2 illustrates an example heater that may be used with the cathode of FIG. 1, according to certain embodiments.
Figure 3:
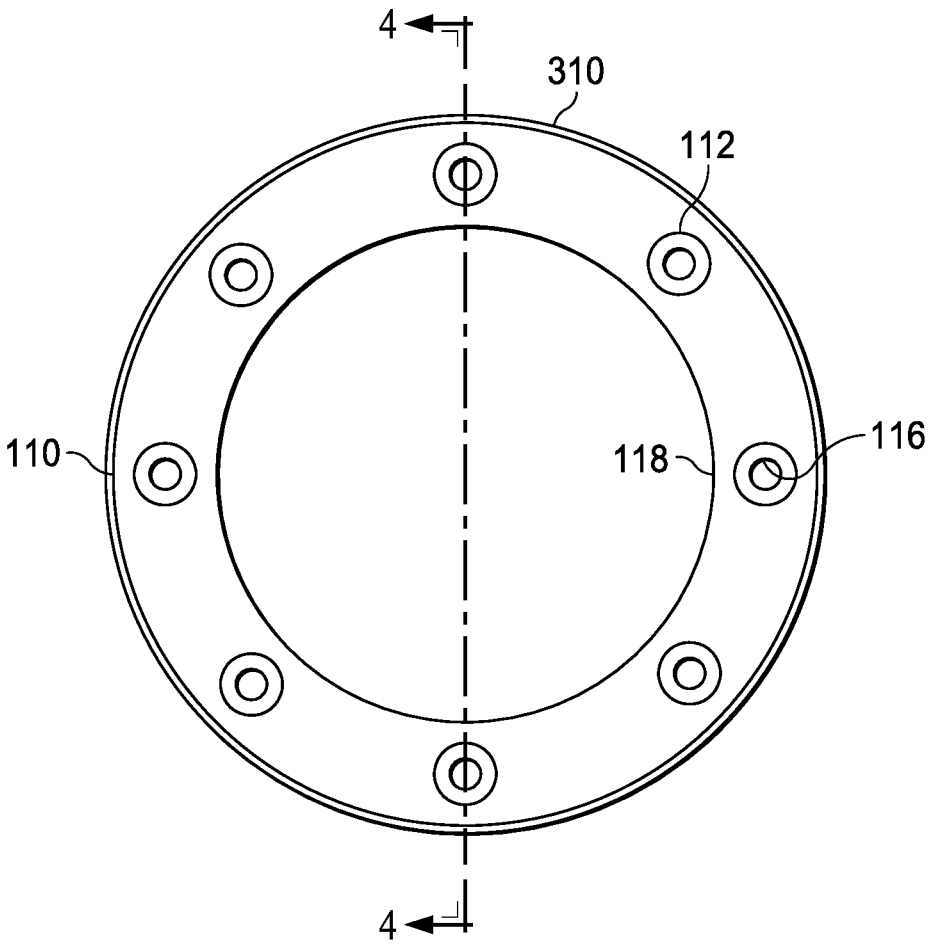
FIG. 3 illustrates an end view of the heater of FIG. 2, according to certain embodiments.
Figure 4:
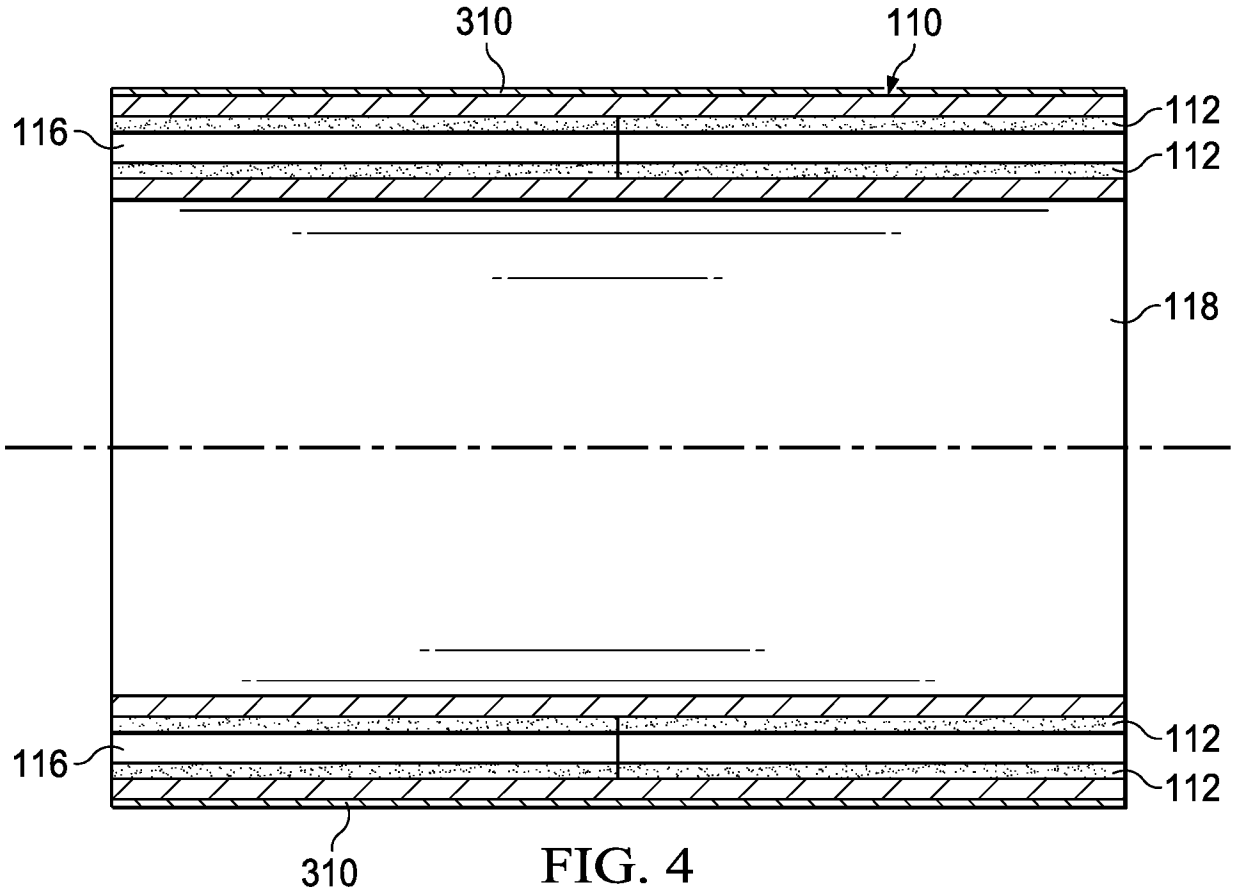
FIG. 4 illustrates a section view of the heater of FIG. 2, according to certain embodiments.
Figure 5:
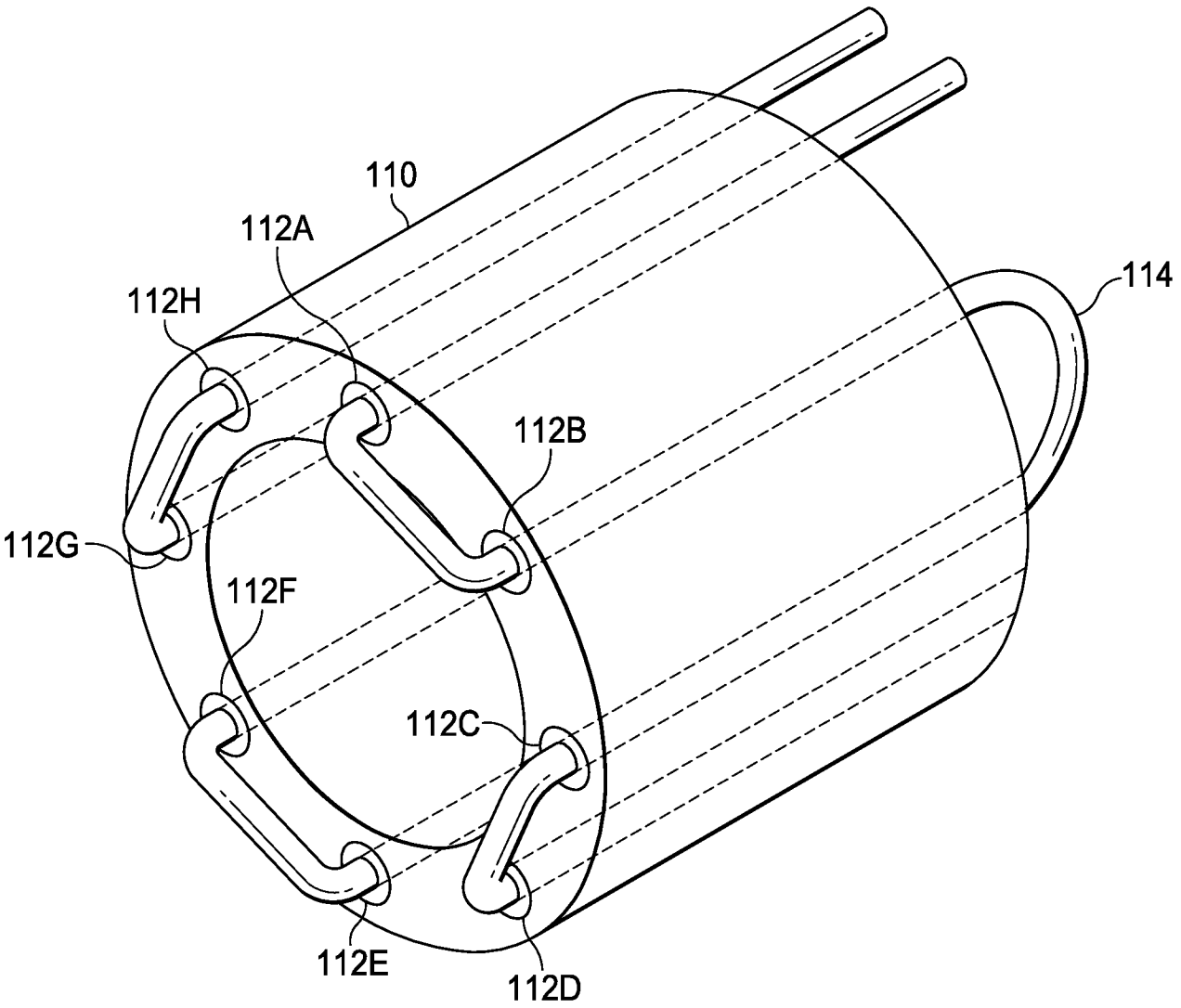
FIG. 5 illustrates a wire installed in the heater of FIG. 2, according to certain embodiments.

FIG. 2 illustrates an example heater 110 that may be used with cathode 100 of FIG. 1, according to certain embodiments. In addition, FIG. 3 illustrates an end view of heater 100, FIG. 4 illustrates a section view of heater 100, and FIG. 5 illustrates a heater wire 114 installed in heater 110, according to certain embodiments. As illustrated in FIGS. 2-3, some embodiments of heater 110 are in a shape of a hollow circular cylinder. In other embodiments, heater 110 may be in any other appropriate shape. In some embodiments, heater 110 partially or fully surrounds cathode 100 (e.g., cathode tube 120). A surface 118 of heater 110 is heated, thereby heating thermionic emitter 130 for proper operation.

Heater 110 includes multiple insulating tubes 112 that hold heater wire 114. For example, the illustrated embodiment of heater 110 includes eight insulating tubes 112: 112A-112H. In other embodiments, however, heater 110 may have any other appropriate number of insulating tubes 112 as required by specific designs and heating requirements. In addition, while a specific arrangement of insulating tubes 112 is illustrated, any other appropriate arrangement may be used. Heater 110 may be formed partially or entirely from graphite, tungsten, rhenium, and the like.

In general, insulating tubes 112 run from a first end 210 of heater 110 to a second end 220 of heater 110. Second end 220 is opposite from first end 210. Each insulating tube 112 is formed from an insulating material such as ceramic and includes a space 116 for heater wire 114. In some embodiments, insulating tube 112 is in the shape of a hollow circular cylinder and space 116 is in the shape of a cylinder. However, any other appropriate shapes for insulating tube 112 and space 116 may be used. Typically, operational failures in heater designs are primarily caused by ceramic insulation breakdown. Heater 110, however, is easily repaired by simply removing and inserting new insulating tubes 112 and heater wire 114 upon failure.

In some embodiments, insulating tubes 112 are formed partially or entirely from a ceramic. In some embodiments, the ceramic may be alumina, Shapal, halfnium oxide, boron nitride, magnesium oxide, or any other appropriate insulating material. In some embodiments, the ceramic used is chosen for specific temperature ranges. For example, alumina may be used for temperatures less than 1650 degrees Celsius, Shapal may be used for temperatures up to 1900 degrees Celsius, and hafnium oxide may be used for temperatures up to 2700 degrees Celsius.

Heater wire 114 is generally any appropriate metal that is resistively heated by an electrical current passed through the heater wire 114. In some embodiments, heater wire 114 is any appropriate refractory metal such as tantalum, rhenium, tungsten, and the like. For example, tantalum may be used for heater wire 114 when insulating tube 112 is alumina insulation, while rhenium wire may be used when insulating tube 112 is Shapal, hafnium oxide, or boron nitride. As another example, rhenium may be used for heater wire 114 when insulating tube 112 is Shapal and boron nitride to prevent embrittlement due to boron diffusion.

In some embodiments, heater wire 114 snakes back-and-forth through each insulating tube 112 of heater 110 as illustrated best in FIG. 5. In this example, heater wire 114 enters second end 220 of heater 110 through insulating tube 112A and travels through insulating tube 112A where it exits insulating tube 112A at first end 210. Heater wire 114 then enters insulating tube 112B at first end 210 and travels through insulating tube 112B where it exits insulating tube 112B at second end 220. Heater wire 114 then enters insulating tube 112C at second end 220 and travels through insulating tube 112C where it exits insulating tube 112C at first end 210. Heater wire 114 then enters insulating tube 112D at first end 210 and travels through insulating tube 112D where it exits insulating tube 112D at second end 220. Heater wire 114 then enters insulating tube 112E at second end 220 and travels through insulating tube 112E where it exits insulating tube 112E at first end 210. Heater wire 114 then enters insulating tube 112F at first end 210 and travels through insulating tube 112F where it exits insulating tube 112F at second end 220. Heater wire 114 then enters insulating tube 112G at second end 220 and travels through insulating tube 112G where it exits insulating tube 112G at first end 210. Heater wire 114 then enters insulating tube 112H at first end 210 and travels through insulating tube 112H where it exits insulating tube 112H at second end 220.

In some embodiments, one or more ceramic beads 140 may be used to protect exposed portions of heater wire 114 as illustrated in FIG. 1. In particular, one or more ceramic beads 140 may be used to cover either partially or fully the portion of heater wire 114 that is exposed at both ends of heater 110 (e.g., at first end 210 and second end 220) as illustrated. Any appropriate insulating material may be used for ceramic beads 140. In addition, any appropriate shape and number of ceramic beads 140 may be used.

In some embodiments, a foil 310 as illustrated in FIGS. 3-4 may be used to increase the efficiency of heater 110. In some embodiments, foil 310 is any appropriate reflective metal material such as tantalum, tungsten, or other refractory metals.

In some embodiments, heater 110 is a separate component that is installed on cathode tube 120. In other embodiments, heater 110 may be formed directly in cathode tube 120. In embodiments where heater 110 is formed directly in cathode tube 120, holes for insulating tubes 112 may be drilled directly into cathode tube 120. Insulating tubes 112 may then be inserted in the drilled holes. This provides an additional advantage of reducing the part count, improving thermal contact, and simplifying the design of cathode 100.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, functions, operations, or steps, any of these embodiments may include any combination or permutation of any of the components, elements, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A system, comprising:
a cathode comprising a cathode tube;
a thermionic emitter installed at least partially within the cathode tube; and
a graphite heater surrounding the cathode tube and configured to heat the thermionic emitter, the graphite heater being in a shape of a hollow circular cylinder, the graphite heater comprising:
a first end;
a second end opposite the first end;
a plurality of hollow ceramic insulating tubes that each run from the first end to the second end; and
a heater wire that runs through each of the hollow ceramic insulating tubes, the heater wire configured to be resistively heated by an electrical current passed through the heater wire.

2. The system of claim 1, wherein the ceramic of the plurality of hollow ceramic insulating tubes is selected from the group consisting of:
alumina;
shapal;
halfnium oxide;
boron nitride; and
magnesium oxide.

3. The system of claim 1, wherein the heater wire is formed from a refractory metal.

4. The system of claim 3, wherein the refractory metal is selected from the group consisting of:
tantalum;
rhenium;
tungsten; and
molybdenum.

5. The system of claim 1, wherein the graphite heater is at least partially surrounded by a reflective foil.

6. A system, comprising:
a cathode comprising a cathode tube;
a thermionic emitter installed at least partially within the cathode tube; and
a heater surrounding the cathode tube and configured to heat the thermionic emitter, the heater comprising:
a first end;
a second end opposite the first end;
a plurality of hollow insulating tubes that each run from the first end to the second end; and
a heater wire that runs through each of the hollow insulating tubes, the heater wire configured to be resistively heated by an electrical current passed through the heater wire.

7. The system of claim 6, wherein the heater is in a shape of a hollow circular cylinder.

8. The system of claim 6, wherein the heater is formed from:
graphite;
tungsten;
rhenium; or
molybdenum.

9. The system of claim 6, wherein each of the plurality of hollow insulating tubes are formed from ceramic.

10. The system of claim 9, wherein the ceramic is selected from the group consisting of:
alumina;
shapal;
halfnium oxide;
boron nitride; and
magnesium oxide.

11. The system of claim 6, wherein the heater wire is formed from a refractory metal.

12. The system of claim 11, wherein the refractory metal is selected from the group consisting of:
tantalum;
rhenium;
tungsten; and
molybdenum.

13. The system of claim 6, wherein the heater is at least partially surrounded by a reflective foil.

14. A system, comprising:
a thermionic emitter; and
a heater at least partially surrounding the thermionic emitter, the heater configured to heat the thermionic emitter, the heater comprising:
a first end;
a second end opposite the first end;
a plurality of hollow insulating tubes that each run from the first end to the second end; and
a heater wire that runs through each of the hollow insulating tubes, the heater wire configured to be resistively heated by an electrical current passed through the heater wire.

15. The system of claim 14, wherein the heater is in a shape of a hollow circular cylinder.

16. The system of claim 14, wherein the heater is formed from:
graphite;
tungsten;
molybdenum; or
rhenium.

17. The system of claim 14, wherein each of the plurality of hollow insulating tubes are formed from ceramic.

18. The system of claim 17, wherein the ceramic is selected from the group consisting of:
alumina;
shapal;
halfnium oxide;
boron nitride; and
magnesium oxide.

19. The system of claim 14, wherein the heater wire is formed from a refractory metal, the refractory metal being selected from the group consisting of:

tantalum;

rhenium;

tungsten; and molybdenum.

20. The system of claim 14, wherein the heater is at least partially surrounded by a reflective foil.

* * * * *